US007065293B2

(12) United States Patent
Thweatt, Jr.

(10) Patent No.: US 7,065,293 B2
(45) Date of Patent: Jun. 20, 2006

(54) HEATER FOR VACUUM CLEANERS

(75) Inventor: Carlisle Thweatt, Jr., South Haven, MI (US)

(73) Assignee: Global Heating Solutions, Inc., Allegan, MI (US)

( * ) Notice: Subject to any disclaimer, the term of this patent is extended or adjusted under 35 U.S.C. 154(b) by 0 days.

(21) Appl. No.: 11/204,871

(22) Filed: Aug. 16, 2005

(65) Prior Publication Data

US 2005/0276586 A1 Dec. 15, 2005

Related U.S. Application Data

(63) Continuation of application No. 10/752,059, filed on Jan. 6, 2004, now Pat. No. 6,941,064, which is a continuation-in-part of application No. 09/827,232, filed on Apr. 5, 2001, now Pat. No. 6,873,793.

(51) Int. Cl.
*F24H 1/10* (2006.01)

(52) U.S. Cl. ..... 392/488; 392/465

(58) Field of Classification Search ..... None
See application file for complete search history.

(56) References Cited

U.S. PATENT DOCUMENTS

| | | | |
|---|---|---|---|
| 2,775,683 | A | 12/1956 | Kleist |
| 3,088,017 | A | 4/1963 | Schomann |
| 3,835,294 | A | 9/1974 | Krohn et al. |
| 3,890,143 | A | 6/1975 | Skoglund et al. |
| 4,085,308 | A | 4/1978 | Youngquist |
| 4,182,948 | A | 1/1980 | Markum et al. |
| 4,185,187 | A | 1/1980 | Rogers |
| 4,308,636 | A | 1/1982 | Davis |
| 4,762,980 | A | 8/1988 | Insley |
| 4,924,069 | A | 5/1990 | Giordani |
| 5,220,638 | A | 6/1993 | Moore et al. |
| 5,396,574 | A | 3/1995 | Base et al. |
| 5,536,478 | A | 7/1996 | Lipp et al. |
| 5,875,283 | A | 2/1999 | Yane et al. |
| 5,963,580 | A | 10/1999 | Eckert |
| 5,978,550 | A | 11/1999 | Rochelle |
| 6,080,973 | A | 6/2000 | Thweatt, Jr. |
| 6,131,237 | A | 10/2000 | Kasper et al. |
| 6,192,549 | B1 | 2/2001 | Kasen et al. |
| 6,621,985 | B1 | 9/2003 | Thweatt, Jr. |
| 6,873,793 | B1 | 3/2005 | Thweatt, Jr. |
| 6,941,064 | B1 * | 9/2005 | Thweatt, Jr. ..... 392/488 |

OTHER PUBLICATIONS

"Tubular Heaters", Ogden Manufacturing Co., www.ogdenmfg.com.

* cited by examiner

*Primary Examiner*—Thor S. Campbell
(74) *Attorney, Agent, or Firm*—Price, Heneveld, Cooper, DeWitt & Litton, LLP

(57) ABSTRACT

A heater for fluids includes a housing made of a non-metallic material and having an internal cavity. The housing has an inlet and an outlet, each of which are in fluid communication with the internal cavity. An elongated electrical heating element is disposed within the cavity for heating fluid flowing through the cavity. The heating element has a generally circular cross-sectional shape and has a U-shaped portion disposed in the cavity. The electrical heating element has electrical connectors at opposite ends extending through the housing, and a titanium outer surface.

20 Claims, 3 Drawing Sheets

HEATER FOR VACUUM CLEANERS

CROSS-REFERENCE TO RELATED APPLICATIONS

The present application is a continuation of U.S. patent application Ser. No. 10/752,059 filed Jan. 6, 2004, now U.S. Pat. No. 6,941,064, which is a continuation-in-part of U.S. patent application Ser. No. 09/827,232, filed Apr. 5, 2001, now U.S. Pat. No. 6,873,793, the entire contents of each of which are incorporated by reference.

BACKGROUND OF THE INVENTION

Various vacuum cleaners have been developed that include a reservoir that holds cleaning fluid. The cleaning fluid is heated and deposited on the floor surface to be cleaned where it contacts a rotating brush of the vacuum cleaner. The cleaning fluid, dirt, and other material is then vacuumed from the floor surface. Heaters used for such vacuum cleaners are exposed to a harsh environment due to the caustic nature of the cleaning solution that flows through the heater, such that the heating elements may corrode or otherwise degrade. Also, such heaters are prone to lime buildup on the heating element that may reduce the effectiveness of the heater.

SUMMARY OF THE INVENTION

One aspect of the present invention is a heater for fluids including a housing made of a non-metallic material and having an internal cavity. The housing has an inlet and an outlet, each of which are in fluid communication with the internal cavity. An elongated electrical heating element is disposed within the cavity for heating fluid flowing through the cavity. The heating element has a generally circular cross-sectional shape and has a U-shaped portion disposed in the cavity. The electrical heating element has a titanium outer surface and includes electrical connectors at opposite ends extending through the housing.

Another aspect of the present invention is a heater for fluids including a housing made of a non-metallic material and defining a sidewall and an internal cavity and an opening through the sidewall. An elongated electrical heating element is disposed in the internal cavity, and has opposite ends extending through the sidewall. A metallic member is disposed at the opening in the housing, and has an inner surface exposed to the internal cavity. A temperature sensor is operably coupled to the metallic member to determine the temperature of the metallic member.

Yet another aspect of the present invention is a vacuum cleaner including a frame, a powered rotating brush, a suction unit, and a fluid container for liquid cleaning solution. A fluid conduit is provided for transport of liquid cleaning solution from the fluid container to an area adjacent the rotating brush. The vacuum cleaner further includes a heater operably connected to the fluid conduit for heating fluid flowing therethrough. The heater includes a housing defining an internal cavity and a heating element is disposed within the internal cavity of the housing. The heating element includes a titanium outer surface that contacts liquid cleaning solution in the housing.

These and other features, advantages, and objects of the present invention will be further understood and appreciated by those skilled in the art by reference to the following specification, claims, and appended drawings.

DETAILED DESCRIPTION OF PREFERRED EMBODIMENT

Figure 1:
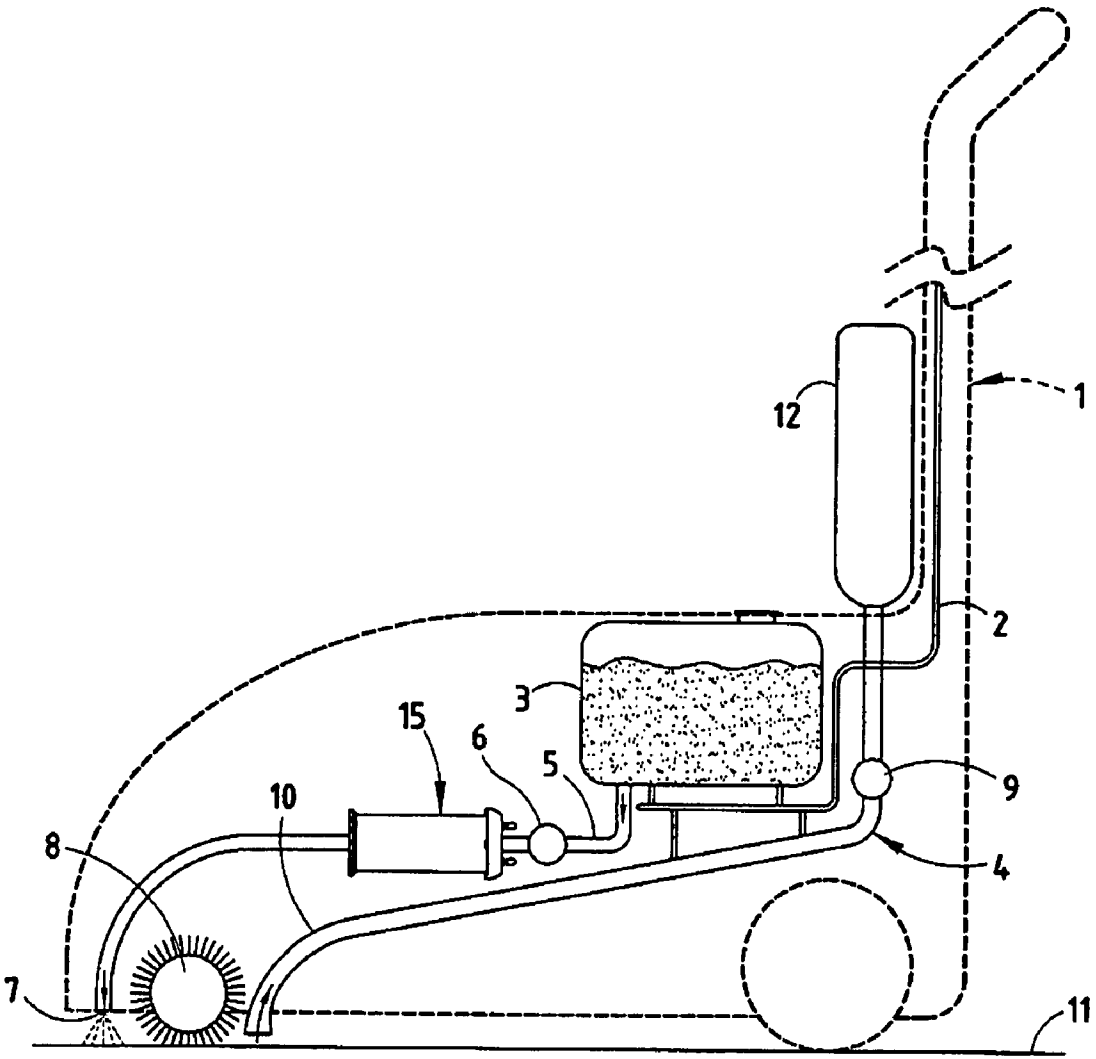
FIG. 1 is a partially schematic view of a vacuum cleaner including a reservoir for liquid cleaning solution and a heater according to one aspect of the present invention.
Figure 2:
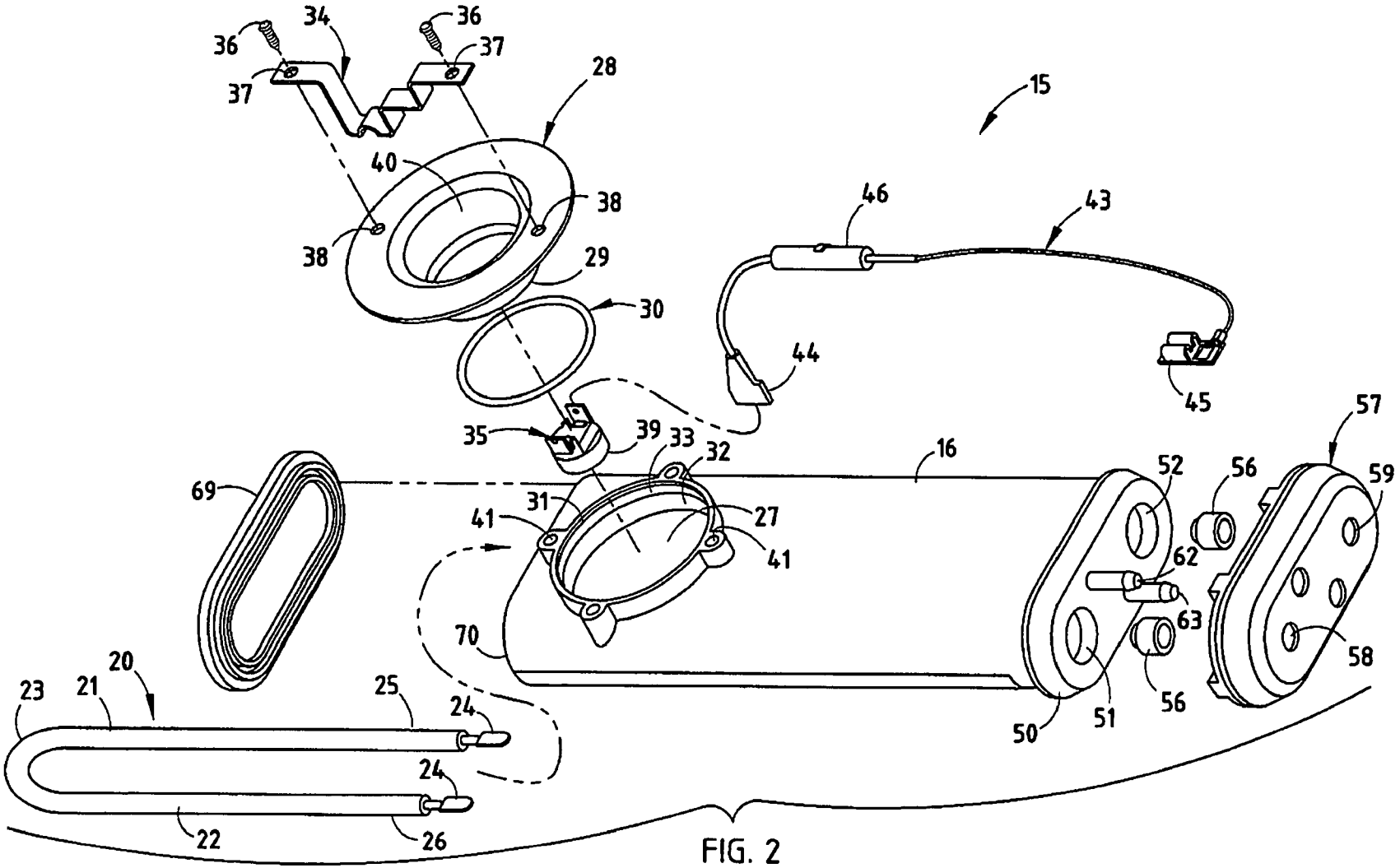
FIG. 2 is an exploded perspective view of the heater of FIG. 1.

For purposes of description herein, the terms "upper," "lower," "right," "left," "rear," "front," "vertical," "horizontal," and derivatives thereof shall relate to the invention as oriented in FIGS. 1 and 2. However, it is to be understood that the invention may assume various alternative orientations and step sequences, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

With reference to FIG. 1, a vacuum cleaner 1 generally includes a frame 2, a fluid reservoir 3, and a vacuum system 4. A fluid conduit assembly 5 includes a pump 6 that deposits fluid 7 from the reservoir 3 adjacent a powered rotating brush 8. A pump 9 generates a vacuum in conduit 10 to pull the fluid 7, dirt, and other debris from the floor surface 11 and into a storage container or bag 12. The frame 2, fluid reservoir 3, conduit assembly 5, and vacuum system 4 may be of various known designs, and will therefore not be described in more detail herein.

A heater 15 according to one aspect of the present invention may be utilized to heat the cleaning fluid before the fluid is deposited adjacent the powered brush 8. With further reference to FIG. 2, the heater 15 includes a housing 16 that is made of a polymer material. The housing has a generally oval cross-sectional shape defining sidewalls 17 and 18 (see also FIG. 4). An electrical heating element 20 is generally U-shaped including elongated parallel portions 21 and 22, a curved portion 23, and includes electrical connectors 24 at the opposite ends 25 and 26 of heating element 20. The heating element 20 preferably has a titanium outer sheath, a titanium inner sheath, a dielectric powder material, and an inner heating wire substantially as described in the above-identified U.S. patent application Ser. No. 09/827,232, entitled ELECTRIC WATER HEATER.

A cup-shaped metal member 28 includes an end portion 29 that is received in opening 27 of housing 16 when assembled. A ring-like gasket 30 is made of a high temperature silicone rubber material, and provides a watertight seal between the cup-shaped metal member 28 and the housing 16. Opening 27 is defined by an outer cylindrical surface 31 and inner cylindrical surface 32. The inner cylindrical surface 32 has a diameter that is less than that of the outer cylindrical surface 31, and a tapered step 33 extends between the outer cylindrical surface 31 and the inner cylindrical surface 32. The tapered step 33 has a frusto-conical shape. When the cup-shaped metal member 28 is assembled to the housing 16, the gasket 30 is compressed against the tapered step 33, thereby deforming the gasket 30 and wedging it into tight contact with the cup-shaped metal member 28 and surfaces 31, 32 and 33 of housing 16. The metallic member 28 may be made of anodized aluminum or other suitable material having sufficient heat-transfer and corrosion resistance properties.

A thermostat 35 has an end 39 that is held in contact with inner surface 40 of metal member 28 by a clip 34. When assembled, screws 36 extend through openings 37 in clip 34, openings 38 in metal member 28, and into openings 41 in housing 16 to thereby retain the end 39 of thermostat 35 in contact with inner surface 40 of metal member 28. The screws 36 also compress the gasket 30 to provide a watertight seal between the metal member 28 and housing 16. Because the metal member 28 readily conducts heat, the end 39 of thermostat 35 is kept at substantially the same temperature as fluid flowing within the housing 16. In this way, the thermostat 35 is protected from the potentially caustic fluid, yet is still maintained at substantially the same temperature as the fluid in the housing 16. A thermal cutout assembly 43 includes an electrical connector 44 that connects to the thermostat 35, and a second electrical connector 45 that connects to an electrical connector 24 of heating element 20. The thermal cutout assembly 43 includes a thermal cutout 46 that shuts off the heater element 20 when the temperature of the thermostat 35 is at or above a preselected temperature. The thermal cutout 46 thereby prevents overheating of the heating element 20 and associated components if fluid flow through the heater 15 is stopped, or if the fluid otherwise reaches too high of a temperature. The thermal cutout 46 and related electrical components are of a known design, such that these components will not be described in detail herein.

Housing 16 has a first end 50 having a first opening 51 and a second opening 52, each of which include an outer cylindrical surface 53, tapered step 54 and inner cylindrical surface 55. When assembled, the end portions 25 and 26 of heating element 20 extend through openings 51 and 52, and ring-like silicone rubber gaskets 56 fit tightly against the surfaces 53, 54 and 55 to thereby provide a waterproof seal. A cover 57 includes first and second openings 58 and 59 through which the ends 25 and 26 extend, and the cover 57 includes connectors 60 that extend around lip 61 of housing 16 to thereby tightly retain the cover 57 on the housing 16.

Figure 3:
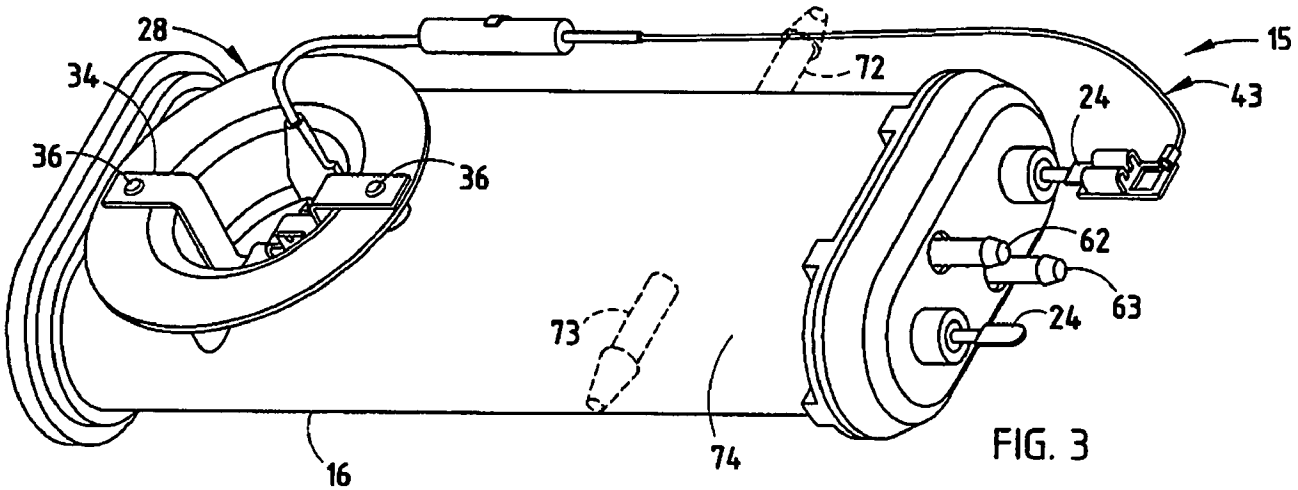
FIG. 3 is a perspective view of the heater in an assembled condition.
Figure 4:
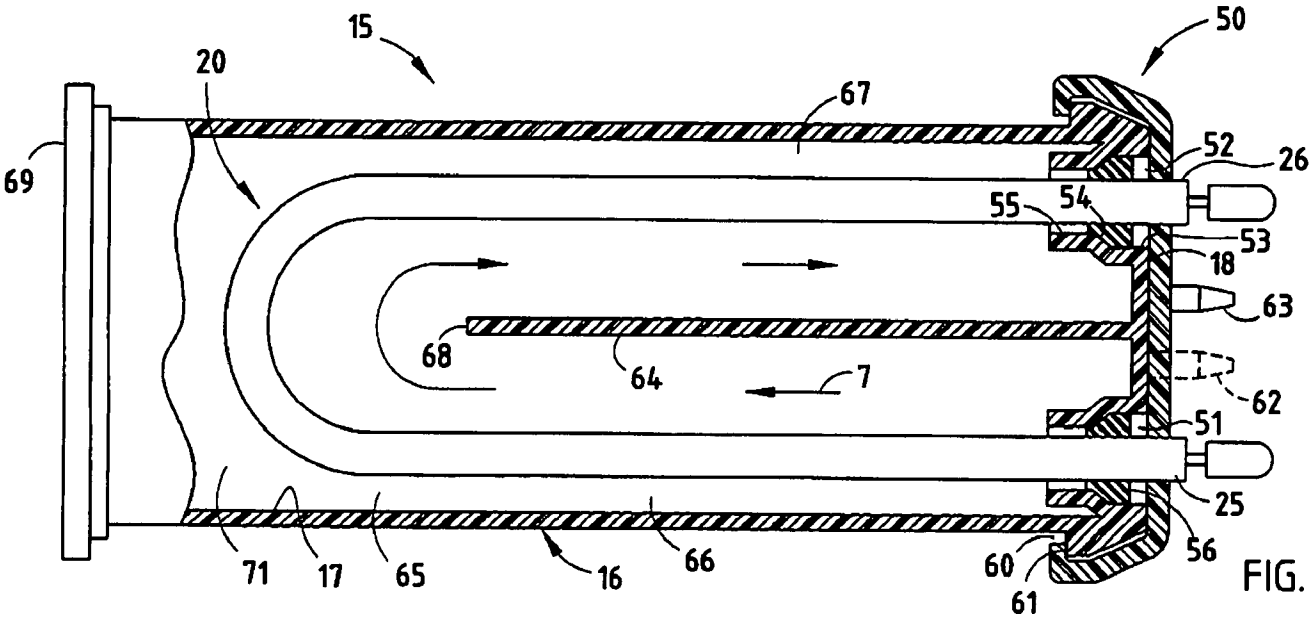
FIG. 4 is a cross-sectional view of the heater.

A pair of barbed fluid connectors 62 and 63 may be formed at the first end 50 of housing 16. With reference to FIG. 4, housing 16 includes a divider wall 64 that forms a generally U-shaped internal cavity 65 having generally parallel first and second portions 66 and 67. A polymer cover 69 closes off the open second end 70 of housing 16, and may be welded thereto. End 68 of divider wall 64 is spaced apart from cover 69 to form a gap 71 interconnecting the first and second portions 66 and 67 of internal cavity 65. This arrangement causes the fluid 7 in housing 16 to flow in a generally U-shaped pattern, such that the fluid 7 is heated by the heating element. As illustrated in FIG. 3, barbed fluid connectors 72 and 73 may alternately be positioned at an end sidewall portion 74 of housing 16.

The heater of the present invention may be fabricated in a very cost-effective manner, and the titanium heating element alleviates lime buildup and other problems associated with known heaters. Furthermore, the cup-shaped metal member and thermostat provide for accurate determination of the temperature of the fluid in the housing, despite the fact that the housing does not readily transfer heat. Still further, the silicone rubber fitting arrangements provide for a very secure watertight interconnection where the various components extend through the housing sidewalls. The silicone rubber accommodates differences in thermal expansion between the various components, such that a watertight seal is maintained across a range of operating conditions and temperatures.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A heater for fluids, comprising:

a housing made of a non-metallic material and having a generally tubular construction forming an internal cavity and defining a first end and a second end having an enlarged opening, the housing including a first pair of openings forming an inlet and an outlet adjacent the first end, each of which are in fluid communication with the internal cavity, the housing including an end sidewall closing off the second end, the end sidewall having first and second access openings therethrough, the housing further including an integral divider wall extending from the end sidewall between the first and second access openings and across the cavity to divide the cavity into first and second portions adjacent the first end, the divider wall having an edge spaced from the second end to form a gap fluidly connecting the first and second portions of the cavity;

an elongated electrical heating element having a titanium outer surface, the heating element disposed within the cavity for heating fluid flowing through the cavity, the heating element having a generally circular cross-sectional shape and having a pair of leg portions extending on opposite sides of the divider wall and defining a maximum width, the heating element including an intermediate portion connecting the leg portions and extending through the gap adjacent the edge of the divider wall and having electrical connectors at opposite ends of the electrical heating element extending through the first and second access openings in the end sidewall of the housing;

a cap member sealingly secured to the housing and closing off the enlarged opening at the second end, and wherein:

the enlarged opening has a dimension that is at least about as large as the maximum width of the electrical heating element to permit placement of the electrical heating element in the cavity substantially without deforming the electrical heating element.

2. The heater of claim 1, wherein:

the cap member is welded to the housing.

3. The heater of claim 1, wherein:

the housing has a sensor opening therethrough; and including:

a metallic member disposed at the sensor opening and having an inner surface adapted to contact fluid in the cavity of the housing;

a sensor operably connected to the metallic member to determine a temperature of fluid in the housing.

4. The heater of claim 3, wherein:

the sensor opening in the housing is substantially circular; and the metallic member is substantially cup-shaped with a portion of the metallic member disposed in the sensor opening.

5. The heater of claim 4, wherein:

the metallic member includes an outwardly extending peripheral flange; and including:

a ring-like gasket made of an elastomeric material disposed between the peripheral flange and the housing to form a seal.

6. The heater of claim 5, wherein:

the sensor opening includes an outer cylindrical surface portion defining a first diameter and an inner cylindrical portion defining a second diameter that is less than the first diameter, the sensor opening having a tapered step surface extending between the inner and outer cylindrical portions, the gasket contacting the tapered step surface.

7. The heater of claim 1, wherein:

access opening defines a tapered sidewall step portion, and including:

a pair of ring-like elastomeric gaskets in the access openings contacting the tapered sidewall step portions of the access openings and the end portions of the heating element to provide a waterproof seal.

8. The heater of claim 1, wherein:

the housing and the cap member are made of a polymer material.

9. The heater of claim 1, wherein:

the housing has a main body portion having a generally oval cross-sectional shape having open opposite ends, and a pair of end caps sealingly closing off the opposite ends.

10. The heater of claim 1, wherein:

the electrical heating element comprises a titanium outer sleeve that fits tightly around a stainless steel inner sleeve, the electrical heating element further comprising a conductive heater wire disposed inside the stainless steel inner sleeve, and a dielectric material in the stainless steel inner sleeve electrically isolating the heater wire from the stainless steel inner sleeve.

11. The heater of claim 1, wherein:

the inlet and the outlet are formed in the end sidewall.

12. The heater of claim 11, wherein:

the inlet and the outlet comprise tubular extensions.

13. The heater of claim 1, wherein:

the leg portions of the heating element extend generally parallel to the divider wall.

14. The heater of claim 13, wherein:

the leg portions and the divider wall are generally straight.

15. The heater of claim 1, wherein:

the intermediate portion of the electrical heating element is curved, such that the electrical heating element is U-shaped.

16. The heater of claim 15, wherein:

the intermediate portion of the electrical heating element is spaced apart from the edge of the divider wall.

17. The heater of claim 16, wherein:

the electrical heating element is solely supported within the housing at the opposite ends of the electrical heating element.

18. A heater for fluids, comprising:

a polymer housing defining a cavity and including a sidewall having an oblong cross-sectional shape defining a height and a width that is substantially greater than the height, the housing having opposite ends including a first end wall and a second end wall, the first end wall having a pair of openings therethrough, the housing further including an inlet opening and an outlet opening to provide flow of fluid through the cavity; and an elongated electrical heating element having a titanium outer surface and having an intermediate portion and a pair of leg portions extending from the intermediate portion to form a U-shape, with opposite ends of the electrical heating element extending through the openings in the first end wall of the housing and supporting the electrical heating element in a cantilevered manner.

19. A heater for fluids, comprising:

a polymer housing defining a cavity and including a sidewall having an oblong cross-sectional shape defining a height and a width that is substantially greater than the height, the housing having opposite ends including a first end wall and a second end wall, the first end wall having a pair of openings therethrough, the housing further including an inlet opening and an outlet opening to provide flow of fluid through the cavity;

an elongated electrical heating element having a titanium outer surface and having an intermediate portion and a pair of leg portions extending from the intermediate portion to form a U-shape, with opposite ends of the electrical heating element extending through the openings in the first end wall of the housing and supporting the electrical heating element in a cantilevered manner; and wherein:

the pair of openings defines tapered inner surfaces having a generally truncated cone shape.

20. A heater for fluids, comprising:

a polymer housing defining a cavity and including a sidewall having an oblong cross-sectional shape defining a height and a width that is substantially greater than the height, the housing having opposite ends including a first end wall and a second end wall, the first end wall having a pair of openings therethrough, the housing further including an inlet opening and an outlet opening to provide flow of fluid through the cavity;

an elongated electrical heating element having a titanium outer surface and having an intermediate portion and a pair of leg portions extending from the intermediate portion to form a U-shape, with opposite ends of the electrical heating element extending through the openings in the first end wall of the housing and supporting the electrical heating element in a cantilevered manner; and wherein the electrical heating element comprises a titanium outer sleeve that fits tightly around a stainless steel inner sleeve, the electrical heating element further comprising a conductive heater wire disposed inside the stainless steel inner sleeve, and a dielectric material in the stainless steel inner sleeve electrically isolating the heater wire from the stainless steel inner sleeve.

* * * * *